United States Patent [19]

Schoeman

[11] 3,953,547

[45] Apr. 27, 1976

[54] CARBURETOR

[76] Inventor: Marthinus Johannes Schoeman, No. 13, 14th Ave., Edenvale, Transvaal, South Africa

[22] Filed: Oct. 3, 1973

[21] Appl. No.: 403,276

[30] Foreign Application Priority Data

| | | |
|---|---|---|
| Jan. 8, 1973 | South Africa | 73/0138 |
| Feb. 19, 1973 | South Africa | 73/1163 |
| Apr. 27, 1973 | South Africa | 73/2891 |

[52] U.S. Cl. ..... 261/18 A; 261/50 A; 261/51; 261/67

[51] Int. Cl.[2] ..... F02M 7/22; F02M 7/16

[58] Field of Search ..... 261/50 A, 51, 67, 18 A

[56] References Cited

UNITED STATES PATENTS

| | | | |
|---|---|---|---|
| 1,286,856 | 12/1918 | Weiland | 261/44 A |
| 1,310,432 | 7/1919 | Pembroke | 261/67 |
| 1,369,419 | 2/1921 | Gibford | 261/67 |
| 1,374,262 | 4/1921 | Wasserlein | 261/44 A |
| 1,493,894 | 5/1924 | Reece | 261/44 A |
| 1,974,286 | 9/1934 | Monosmith et al. | 261/50 A |
| 2,061,494 | 11/1936 | Weber | 261/67 |
| 2,246,408 | 6/1941 | Hammond | 261/50 R |
| 2,583,406 | 1/1952 | Arnold | 261/50 A |
| 2,595,720 | 5/1952 | Snyder | 261/50 A |
| 2,642,852 | 6/1953 | Bester | 261/18 A |
| 3,182,974 | 5/1965 | Hill | 261/50 A |
| 3,266,785 | 8/1966 | Kennedy, Sr. | 261/41 B |
| 3,322,408 | 5/1967 | Stoltman | 261/50 A |
| 3,339,900 | 9/1967 | DeRugeris | 261/67 |
| 3,432,152 | 3/1969 | Sweeney | 261/50 A |

*Primary Examiner*—Tim R. Miles

*Attorney, Agent, or Firm*—Stevens, Davis, Miller & Mosher

[57] ABSTRACT

A carburetor comprising a throttle valve operated control valve controlling the supply of fuel to an air valve operated control valve discharging directly into the carburetor air duct.

4 Claims, 7 Drawing Figures

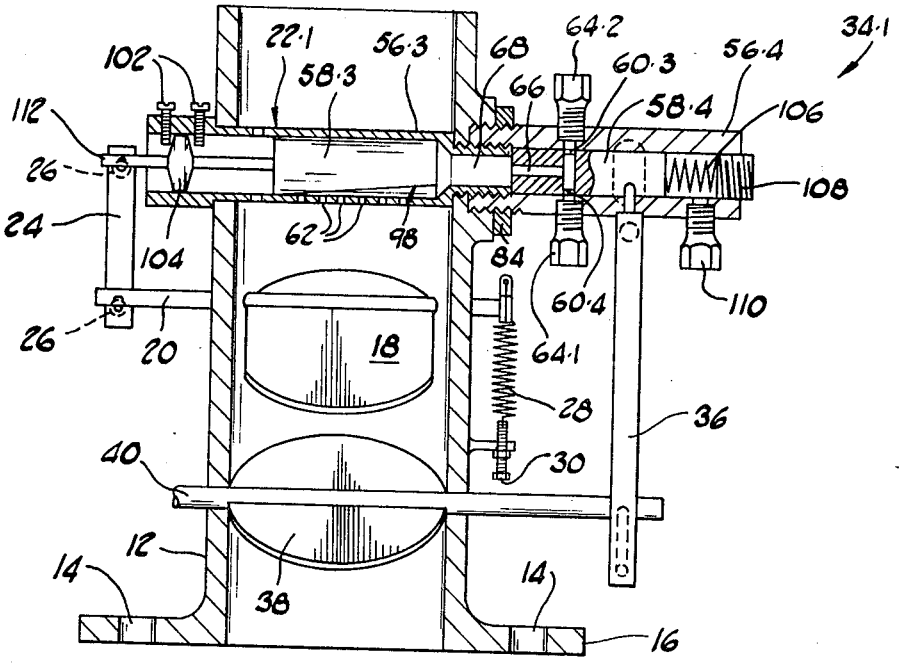
FIG. 4
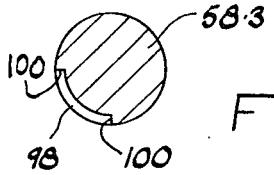
FIG. 6
FIG. 7
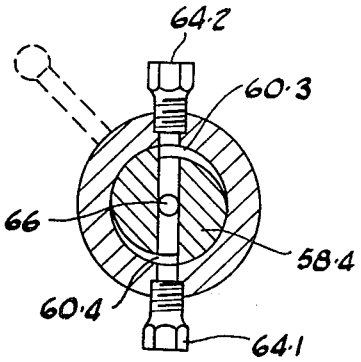
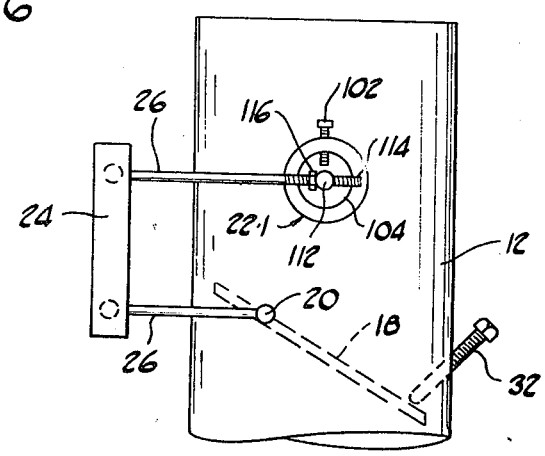
FIG. 5

CARBURETOR

This invention relates to supplying fuel to internal combustion engines.

According to the invention there is provided a carburetor for an in internal combustion engine, which includes a duct connectable to the combustible charge inlet of the engine, a vane mounted to be displaceable by airflow through the duct, and a regulating valve controllably operable by the vane in response to the airflow and adapted to regulate the supply of fuel into the engine.

The vane may be interconnected with the regulating valve by means of a linkage which is adjustable to permit adjustment of the degree of operation of the regulating valve by the vane. The vane may be biassed to an initial inoperative position by biassing means, the bias applied by the biassing means being adjustable. The initial position of the vane may be determined by a stop formation. The stop formation may be adjustable.

The carburettor may accordingly further include at least one control valve in series with the regulating valve and adapted to control the supply of fuel into the regulating valve. The control valve is conveniently operable in conjunction with a conventional butterfly valve provided in the duct. An adjustable linkage is conveniently provided intermediate a spindle on which the butterfly valve is mounted and the control valve.

The regulating valve or the control valve may be in the form of a housing having an inlet and an outlet, with a regulating member in sealing engagement with the inner walls of the housing, the regulating member having a groove formed in its periphery to form a restricted passage between the inlet and the outlet, and the regulating member being controllably displaceable to vary the supply of fuel from the inlet through the restricted passage to the outlet. The regulating member, in the case of the regulating valve, would be displaceable by the vane, and in the case of the control valve, would be displaceable in conjunction with the butterfly valve.

The groove may be tapered and extend around the periphery of the regulating member in alignment with the inlet or with the outlet, the regulating member being rotatably displaceable to permit variation of the volume of fuel capable of being supplied through the groove.

In another embodiment, the groove may extend helically around the regulating member. The helical groove may then be capable of being brought progressively into full alignment with the inlet or with the outlet as the regulating member is rotated. The regulating member may also be axially displaceable relative to the inlet or to the outlet to permit adjustment of the alignment of the groove with the inlet or with the outlet.

In yet another embodiment, the groove may be tapered and extend axially along the regulating member. The regulating member may then be axially displaceable to vary the through-flow through the passage.

When the regulating member of the control or regulating valve is rotatably displaceable, it may be axially displaceable to a minor degree by means of a working fluid, to permit the groove to be brought into slight misalignment with the inlet or with the outlet. The working fluid may be obtained by means of a negative pressure obtained from within the duct when the engine is running against compression to economize on the amount of fuel passed into the engine.

In another form of the carburetor, the regulating valve may include a housing, an inlet to the housing, a plurality of outlets from the housing, and a control member displaceable within the housing by the vane thereby progressively to control the flow of fuel from the inlets to the various outlets. The control member is thus progressively displaced to permit fuel flow to more of the outlets in parallel as the vane is displaced by airflow through the duct.

The regulating valve may then be located transversely to the axis of the duct with the control member rotatably mounted within the housing. The fuel inlet may be at one end and a plurality of axially spaced fuel outlet apertures may be provided intermediate the ends of the housing and directed towards the outlet of the duct.

The axial position of the control member within the housing may conveniently be adjustable to permit adjustment of the numer of outlets with which the inlet is in communication when the control member is in its initial position.

When a plurality of fuels are to be supplied to the engine, e.g. for a two-stroke engine, the control valve may have a plurality of inlets in communication with a common outlet via a plurality of restricted passages. The taper or the cross section of the respective grooves forming the restricted passages, may be different to permit proportioning of different types of fuel fed into the respective inlets.

Various embodiments of the invention will now be described by way of example with reference to the accompanying drawings, in which:

FIG. 4 shows an axial section through a further embodiment of a carburetor in accordance with the invention;

FIG. 5 shows a side elevation of a portion of the carburetor shown in FIG. 4;

FIG. 6 shows a cross-section through a control member in the regulating valve of the carburetor shown in FIG. 4 and FIG. 7 shows a cross-sectional view of one form of control valve which can be used in the carburetor shown in FIGS. 1 or 4.

Figure 1:
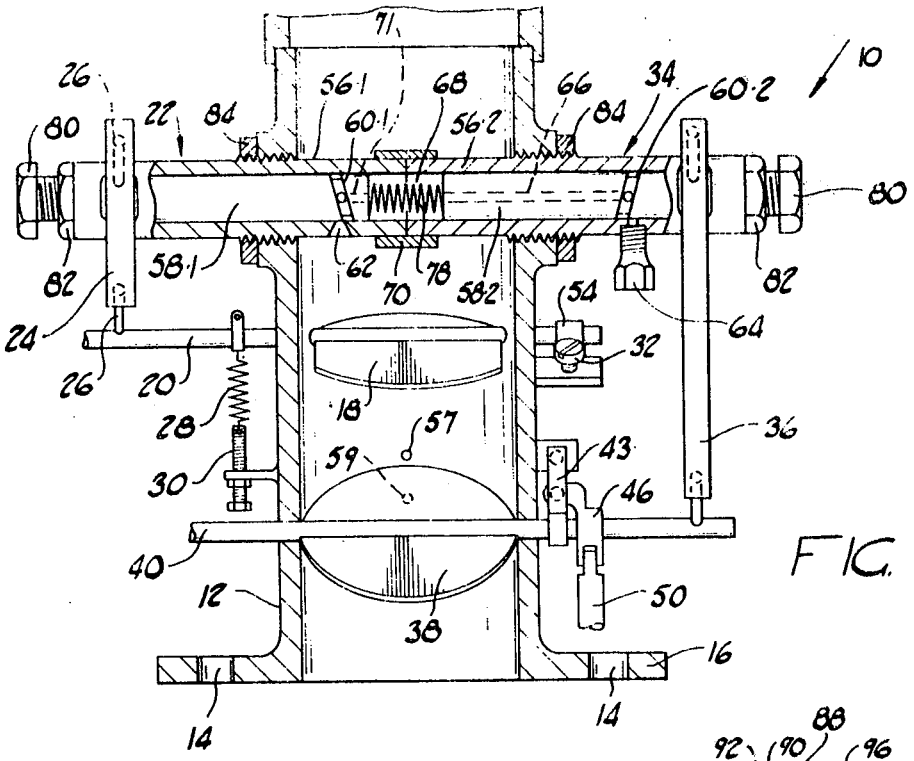
FIG. 1 shows an axial section of a carburetor in accordance with the invention.

Referring to the drawings, reference numeral 10 generally indicates a carburetor for an internal combustion engine. The carburetor includes a duct in the form of a barrel 12 connectable to the inlet of the engine, e.g. to the inlet manifold of an engine via bolts or studs passing through apertures 14 in a flange 16. A vane 18 is mounted within the barrel 12 so as to be displaceable by airflow through the barrel. The vane 18 is mounted on a spindle 20 which is connected to a regulating valve 22 via a linkage 24. The linkage 24 has two arms 26 which engage ball and socket fashion with the linkage 24. The arms 26 are conveniently adjustable in length, e.g. in a fashion similar to that shown in FIG. 5, to permit adjustment of the stroke of the linkage. The length of the linkage 24 is conveniently also adjustable to permit adjustment of the relationship between the vane 18 and the regulating valve 22.

The vane 18 is biassed to an initial inoperative position by a spring 28. The bias applied by the spring 28 is adjustable by means of an adjusting screw 30 thereby to adjust the richness of the mixture fed into the engine at speeds above idling speed. The initial position of the vane 18 is also determined by an adjustable adjusting screw 32.

A control valve 34 is mounted in opposed end-to-end relationship with the regulating valve 22. The control valve 34 is operable by a linkage 36 similar to the linkage 24 in conjunction with a conventional butterfly valve 38 provided in the barrel 12. The butterfly valve 38 is mounted on a spindle 40 which is connected to the conventional throttle linkage of the engine. As shown more clearly in FIG. 2, the initial position of the butterfly valve 38 is determined by a stop formation having an adjusting screw 42 in order to permit adjustment of the idling speed of the engine. The screw 42 acts against an arm 43 fixed to the spindle 40. A stop formation having an adjusting screw 44 is also provided for determining the maximum throttle opening of the butterfly valve 38. In order to provide a fast idling speed when the engine is cold, a link 46 is provided pivotally mounted on the spindle 40. The fast idling speed is determined by an adjusting screw 48. The link 46 is operable by a lever 50 which is connected to a conventional temperature responsive device (not shown) which is usually mounted in proximity to or within the exhaust manifold of the engine.

Figure 2:
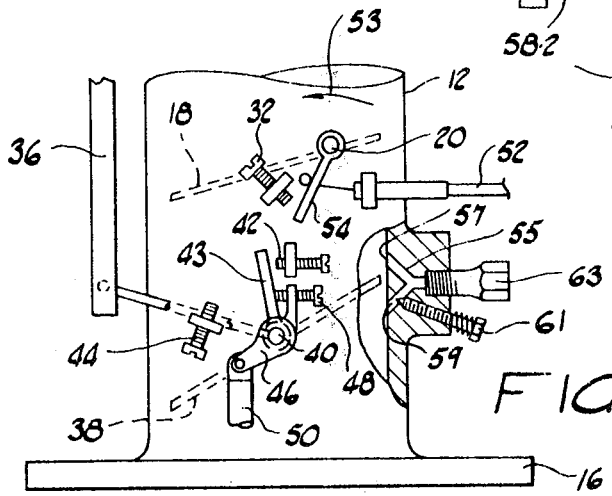
FIG. 2 shows a side elevation of a portion of the carburetor shown in FIG. 1.

Also as shown in FIG. 2, the vane 18 can be displaced by a choke cable 52 to open the regulating valve 22 to assist in starting the engine when it is cold. The cable 52 engages with a limb 54 mounted on the spindle 20. The limb 54 is such that the vane 18 can be displaced freely by airflow through the barrel 12 in the direction of arrow 53, irrespective of the position of the cable 52.

When the butterfly valve 38 is in the idling position, i.e. as illustrated in FIG. 2, air is supplied via a by-pass passage 55 provided in the walls of the barrel 12. The by-pass passage 55 has an inlet 57 and an outlet 59 respectively above and below the position where the upper edge of the butterfly valve 38 is in proximity to the side wall of the barrel 12. Adjustment of the airflow through the by-pass passage 55 is provided by means of an adjusting screw 61 to provide a fine adjustment of air flow under idling conditions. The union 63 in communication with the passage 55 can be used to supply a partial vacuum to the automatic advance mechanism of the distributor of the engine as the butterfly valve 38 opens.

The regulating valve 22 and the control valve 34 each comprise a tubular housing 56.1 and 56.2, in which regulating members 58.1 and 58.2 are sealingly located.

The regulating member 58.1 has a helical groove 60.1 which is progressively brought into alignment with an outlet aperture 62 in the housing 56.1 as the regulating member 58.1 is rotated.

The regulating member 58.2 has a helical groove 60.2 capable of being brought into progressive alignment with an inlet 64 as the regulating member 58.2 is rotated.

Fuel can be supplied to the inlet 64 from a pressurized source such as the fuel pump of the engine. Fuel then enters the helical groove 60.2 and passes through a passage 66 into a chamber 68 which is sealingly enclosed by a collar 70. From the chamber 68, the fuel flows into a passage 71 in the regulating member 58.1, and through the helical groove 60.1 to the outlet 62.

Each of the regulating members 58.1 and 58.2 are biassed outwardly by means of a spring 78 in the chamber 68 against a pair of adjustable stop formations in the form of screws 80 having lock nuts 82. The screws 80 are used to displace the regulating members 58.1 and 58.2 axially to permit adjustment of the alignment of the helical grooves 60.1 and 60.2 with the outlet 62 and inlet 64 respectively to provide a fine adjustment of the volume of fuel fed into the engine.

The housings 56.1 and 56.2 are screw-threaded into the barrel 12 and held in position by lock nuts 84.

Figure 3:
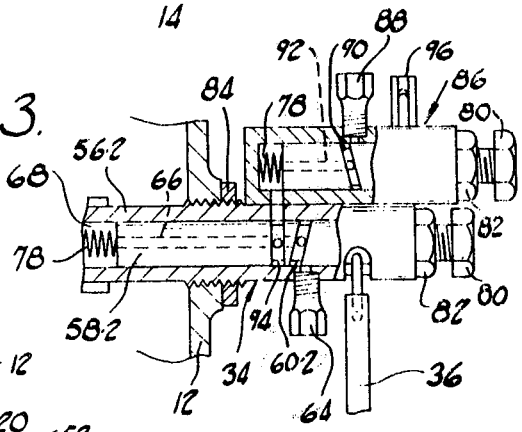
FIG. 3 shows a sectional view of a portion of a modified form of the carburetor shown in FIG. 1.

Referring now to FIG. 3, a modification to the carburetor as shown in FIG. 1 is illustrated. This modification may be used for engines in which a fuel mixture, e.g. petrol and oil, is required. The modification may also be used for supplying a fuel additive to the engine. In order to achieve this, a further control valve 86 is mounted adjacent the control valve 34 and has an inlet 88, a helical groove 90 capable of being brought into progressive alignment with an inlet 88, and a passage 92 which is in communication with an annular groove 94 provided in the regulating member 58.2. If desired, additional control valves similar to the further control valve 86 can be mounted in parallel with the control valves 34 and 86.

With the modification shown in FIG. 3, petrol can be supplied to the inlet 64 and oil or a fuel additive can be ssupplied to the inlet 88. Where petrol, oil and an additive are required, three control valves may be provided. The petrol and the oil or additive is therefore supplied in parallel and a mixture thereof is fed to the regulating valve 22. The control valve 86 is operable by a linkage 96 which can also be linked to the spindle 40 on which the butterfly valve 38 is mounted. It will be appreciated that the amount of oil or additive added to the petrol can be varied by adjusting the stroke of the linkage 96 and/or the angle of the helical groove 90. The initial position of the helical groove 90 relative to the inlet 88 is again determined by an adjusting screw 80 having a lock nut 82. A spring 78 is used to bias the control member of the valve 86 against the screw 80.

Referring now to FIG. 4, a different form of carburetor in accordance with the invention, is shown. Like numerals have been used to indicate like parts of the carburettor shown in FIG. 1.

In this embodiment, the regulating valve 22.1 has a housing 56.3. A plurality of outlets 62 are provided in the housing 56.3. A control member 58.3 is rotatably displaceable within the housing 56.3 by the vane 18. As shown more clearly in FIG. 6, the control member 58.3 has an arcuate groove or slot 98 which forms a restricted communication passage to the outlets 62. The side walls 100 of the slot 98 converge along the length of the control member 58.3 so that as the control member 58.3 is rotated by the vane 18, fuel can flow to more and more of the outlet apertures 62.

The axial position of the control member 58.3 within the housing 56.3 is adjustable by two screws 102 which act against a cam member 104. The screws 102 permit adjustment of the number of apertures 62 which are in communication with the control valve 34.1 via the slot 98 when the vane 18 is in its initial position.

The control valve 34.1 which is in series with the regulating valve 22.1 is of a form similar to the control valve 34 of FIG. 1 except that in place of the helical groove, a pair of diametrically opposed tapering grooves 60.3 and 60.4 are provided in the control member 58.4. This arrangement is more clearly shown in FIG. 7. As shown, fuel e.g. a mixture of petrol and oil, can be supplied to the inlets 64.1 and 64.2. The volume of the respective types of fuel is regulated by the positioning of the control member 58.4 and the mixture is supplied via the passage 66 to the regulating valve 22.1.

Further minor modifications have been made to the control valve 34.1. A spring 106 is used to bias the control member 58.4 against the end of the housing 56.3 of the regulating valve 22.1. The bias applied by the spring 106 is adjustable by means of a screw-threaded plug 108. A further inlet 110 is provided on the control valve 34.1. The inlet 110 is connected to the barrel 12 downstream of the butterfly valve 38 so that a vacuum can be applied to the control member 58.4 and displace it axially against the spring 106. This causes misalignment of the grooves 60.3 and 60.4 with the inlet 64.1 and 64.2 when the engine is running against compression in order to economize on the fuel supplied to the engine.

As shown in FIG. 5, the initial position of the vane 18 is determined by a screw 32. The upper arm 26 of the linkage 24 is connected to the spindle 112 which rotates the regulating member 58.3 by means of a screw-threaded formation 114. In this way, the stroke of the linkage 24 can be adjusted by loosening a lock nut 116 and rotating the upper limb 26. A similar arragement is conveniently provided on the lower limb 26. Additionally or alternatively, the linkage 24 may comprise a pair of members displaceable relative to one another to permit adjustment of the length of the linkage 24.

If desired, in order to improve the effectiveness of the vane 18, baffles could be fitted to the side walls of the barrel 12 in alignment with the parallel edges of the vane 18 so that all the airflow through the barrel is directed against the vane 18.

In use therefore, the control valve 34, 34.1 regulates the flow of fuel to the engine dependent upon the rotation of the butterfly valve 38 caused by operating the throttle linkage of the engine. The flow of fuel to the engine is also controlled by the regulating valve 22, 22.1, so that too much fuel is not supplied to the engine at low speeds or upon sharp acceleration. Thus, only when there is sufficient airflow through the barrel 12 to displace the vane 18, will more fuel be supplied into the barrel. In this way, the instantaneous needs of the engine as determined by the airflow through the barrel are catered to.

The invention accordingly provides a carburetor which can be used for various types of engines and which permits fine regulation of the fuel supplied to the engine at various speeds and under various load conditions. The valves 22 and 34 could be mounted in any position in the barrel 12, e.g. below or above the butterfly valve.

It will be noted that the barrel 12 has no venturi and therefore an unrestricted flow of air is possible into the engine. The carburetor can be fitted in any configuration, i.e. updraft, sidedraft, or downdraft configuration. The fuel is injected into the engine via the regulating and control valves rather than sucked in. Because the regulating valve is arranged to close off the outlet aperture 62 completely when the vane is at its rest position, there is no leakage of fuel into the engine while the engine is at a standstill caused, for example, by pressure in the fuel supply line.

The applicant has found that the carburetter can also be used to operate an internal combustion engine when the fuel used is a gas, such as commercially available liquified petroleum gases. When it is desired to use either a gas or, say, petrol, an additional regulating valve 22 and control valve 34 may be provided fitted to the barrel 12. The existing and the additional regulating valves may then be operable jointly by the existing vane 18. Valves may then be provided in the gas and petrol supply lines to the carburetter, so that either petrol or gas or a mixture of petrol and gas can be fed to the engine as required by the vehicle operator.

Although the control valve 34 assists in controlling the supply of fuel to the engine, it is to be understood that it is not essential, as the fuel can be sufficiently regulated by the regulating valve 22 and butterfly valve 38 only, particularly if gas if used as the fuel.

What I claim is:

1. A carburetor for an internal combustion engine which includes a duct connectable to a combustible charge inlet of the engine; a vane mounted to be displaceable by airflow through the duct; a butterfly valve within the duct and connectable to a throttle linkage of the engine; a regulating valve extending transversely into the duct and having an outlet directly into the duct, the regulating valve including a first regulating member having a helical groove rotatably displaceable into and out of progressive alignment with the outlet; and at least one control valve, the control valve and the regulating valve being connected in series for controlling and regulating fuel flow from a fuel source and into the duct via the outlet, the regulating valve being controllably operable by the vane dependent on the rate of airflow through the duct and the control valve being linked to the butterfly valve to operate in conjunction with the degree of opening of the butterfly valve, and in which the control valve is in the form of a housing having an inlet connected to the fuel source with a second regulating member in sealing engagement with the inner walls of the housing, the second regulating member having a groove formed in its periphery to form a restricted passage between the housing inlet and the outlet, and the second regulating member being controllably displaceable to vary the supply of fuel from the housing inlet through the restricted passage to the outlet.

2. A carburetor as claimed in claim 1, in which the groove of the second regulating member is tapered and extends around the periphery of the second regulating member in alignment with the inlet, the second regulating member being rotatably displaceable to permit variation of the volume of fuel capable of being supplied through the groove.

3. A carburetor as claimed in claim 1, in which the groove of the second regulating member extends helically around the second regulating member, the helical groove of the second regulating member being capable of being brought progressively into full alignment with the inlet as the second regulating member is rotated.

4. A carburetor as claimed in claim 3, in which the second regulating member is also axially displaceable relative to the inlet, to permit adjustment of the alignment of the groove of the second regulating member with the inlet.

* * * * *